US010119534B2

(12) United States Patent
Tanabe

(10) Patent No.: US 10,119,534 B2
(45) **Date of Patent: *Nov. 6, 2018**

(54) TUBE PUMP AND PRINTER PROVIDED WITH THE SAME

(71) Applicant: BROTHER KOGYO KABUSHIKI KAISHA, Nagoya-shi, Aichi-ken (JP)

(72) Inventor: Yuma Tanabe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/651,678

(22) Filed: Jul. 17, 2017

(65) Prior Publication Data

US 2017/0370356 A1 Dec. 28, 2017

Related U.S. Application Data

(63) Continuation of application No. 15/083,931, filed on Mar. 29, 2016, now Pat. No. 9,709,051.

(30) Foreign Application Priority Data

Mar. 31, 2015 (JP) ..... 2015-074664

(51) Int. Cl.
*F04B 43/12* (2006.01)

(52) U.S. Cl.
CPC ..... *F04B 43/12* (2013.01); *F04B 43/1238* (2013.01); *F04B 43/1276* (2013.01)

(58) Field of Classification Search
CPC .. F04B 43/12; F04B 43/1276; F04B 43/1238; B41J 2/17596
USPC ..... 347/30
See application file for complete search history.

(56) References Cited

U.S. PATENT DOCUMENTS 6,082,977 A * 7/2000 Nishioka ..... F04B 43/1238 417/476
6,106,098 A * 8/2000 Nakamura ..... B41J 2/16508 347/30
6,733,255 B2 5/2004 Ota et al.
(Continued)

FOREIGN PATENT DOCUMENTS

JP 59-61943 U 4/1984
JP 2001-301195 A 10/2001
(Continued)

OTHER PUBLICATIONS

Notification of the First Office Action with Search Report from corresponding Chinese Patent Application No. 201610197393.9, dated Apr. 5, 2017.

*Primary Examiner* — Huan Tran
*Assistant Examiner* — Alexander D Shenderov
(74) *Attorney, Agent, or Firm* — Merchant & Gould P.C.

(57) ABSTRACT

A tube pump includes a tube, a housing member having a cylindrical chamber including an inner peripheral surface, a rotator having a first shaft and a first portion, the first portion having a guide, and a roller having a first shank received by the guide. The tube pump includes a contact member having a contact portion in the cylindrical chamber extending outwardly towards the inner peripheral surface at least the first distance and less than the second distance, the contact portion being configured to selectively contact the roller.

12 Claims, 14 Drawing Sheets

(56) References Cited

U.S. PATENT DOCUMENTS

| | | | | |
|---|---|---|---|---|
| 8,529,229 | B2 * | 9/2013 | Asai | B41J 2/16532 417/477.7 |
| 8,568,115 | B2 * | 10/2013 | Lauer | F04B 43/1276 417/477.8 |
| 2003/0169312 | A1 * | 9/2003 | Ota | B41J 2/16523 347/29 |
| 2008/0056918 | A1 * | 3/2008 | Harada | B41J 2/1714 417/412 |
| 2013/0343938 | A1 * | 12/2013 | Hutchison | B41J 2/175 417/477.7 |

FOREIGN PATENT DOCUMENTS

| | | | |
|---|---|---|---|
| JP | P3424697 | B2 | 7/2003 |
| JP | 3473697 | B2 | 12/2003 |
| JP | 3804062 | B2 | 8/2006 |

* cited by examiner

TUBE PUMP AND PRINTER PROVIDED WITH THE SAME

CROSS-REFERENCE TO RELATED APPLICATIONS

This application is a continuation application of U.S. patent application Ser. No. 15/083,931, filed on Mar. 29, 2016, which claims priority from Japanese Patent Application No. 2015-074664, filed on Mar. 31, 2015. The entire content of the priority application is incorporated herein by reference.

BACKGROUND OF THE INVENTION

1. Field of the Invention

The present invention relates to a tube pump and a printer provided with the tube pump.

2. Description of the Related Art

An ink-jet printer performs a cleaning operation in which ink is ejected from an ejection port in order to prevent ejection failures at a print head or other faults. The cleaning operation includes closing a recording head with capping means and applying a negative pressure to the inside of the capping means using the tube pump.

Known examples of such a tube pump used in a printer include a tube pump that receives, from a groove wall of a roller-supporting groove, a force of action that displaces a roller from a pump operation position to a release operation position while the roller stops rotating or turning.

As illustrated in FIG. 13, the existing tube pump includes a tube 151, a pump frame 144, a pump wheel 142 rotated by a motor, and rollers 143*a* and 143*b* that move along roller supporting grooves 142*a* and 142*b* formed in the pump wheel 142. Letter-L-shaped fastening grooves 144*a* and 144*b* are formed in the pump frame 144. Guide members 153*a* and 153*b* made of an elastic material and protruding toward the center of the pump wheel 142 are locked on the fastening grooves 144*a* and 144*b*.

As illustrated in FIG. 13, when the pump wheel 142 is rotated in the direction of an arrow P, the rollers 143*a* and 143*b* move toward the axis of the pump wheel 142 and rotate or turn in the direction of an arrow P while keeping in the release operation state in which the rollers 143*a* and 143*b* slightly come into contact with the tube 151. At this time, in accordance with the rotation of the pump wheel 142, the pair of guide members 153*a* and 153*b* act so as to guide the rollers 143*a* and 143*b* along the respective roller supporting grooves 142*a* and 142*b* in the backward direction of wheel rotation.

However, the above-described existing tube pump has a problem as follows. Due to elastic deformation of the guide members 153*a* and 153*b* at the rotation or rolling of the rollers 143*a* and 143*b*, long time use of the tube pump degrades the guide members 153*a* and 153*b*, which hinders positional changes of the rollers 143*a* and 143*b* between the pump operation position and the release operation position and lowers the pump performance.

SUMMARY OFTHE INVENTION

The present invention is made to address the above-described problem. An object of the invention is to provide a tube pump and a printer including the tube pump that can minimize impairment of the pump performance.

In order to address the existing problem, a tube pump according to an aspect of the invention includes a tube through which fluid is flowed, a housing member comprising a cylindrical chamber in which the tube is accommodated, the cylindrical chamber including an inner peripheral surface along which the tube is arranged, and a rotator comprising a first shaft and a first portion provided on the first shaft, the first portion including a guide having first and second ends, the first end positioned a first distance from the first shaft, the second end positioned a second distance from the first shaft, the second distance being greater than the first distance. The tube pump includes a roller having a first shank received by the guide, the roller configured to selectively press the tube to deform the tube and a contact member having a contact portion in the cylindrical chamber extending outwardly towards the inner peripheral surface at least the first distance and less than the second distance, the contact portion being configured to selectively contact the roller.

In a still further aspect, a tube pump includes a tube through which fluid is flowed, a housing member comprising a cylindrical chamber in which the tube is accommodated, the cylindrical chamber including an inner peripheral surface along which the tube is arranged, and a rotator comprising a rotation shaft and a first portion provided on the rotation shaft, the first portion including a guide, the rotator being rotatable in the cylindrical chamber. The tube pump includes a roller received by the guide to be moved between a pressing position and a release position when the rotator is rotated in first and second rotation directions, respectively and a contact portion, wherein the roller contacts the contact portion when the rotator rotates in the first rotation direction to move the roller from the release position to the pressing position, and the roller does not contact the contact portion when the rotator rotates in the second rotation direction.

Since the roller is allowed to move between the pressing position and the release position as a result of the roller coming into contact with the contact member, the roller is not required to constantly keep in contact with the tube. Thus, the tube and the roller are allowed to be separated from each other, the degradation of the tube can be further minimized than in the case of an existing technology with which the roller is required to constantly keep in contact with the tube, whereby impairment of the pump performance can be minimized.

The tube pump and the printer including the tube pump according to the aspect of the invention can minimize impairment of the pump performance.

DESCRIPTION OF THE PREFERRED EMBODIMENTS

Figure 1:
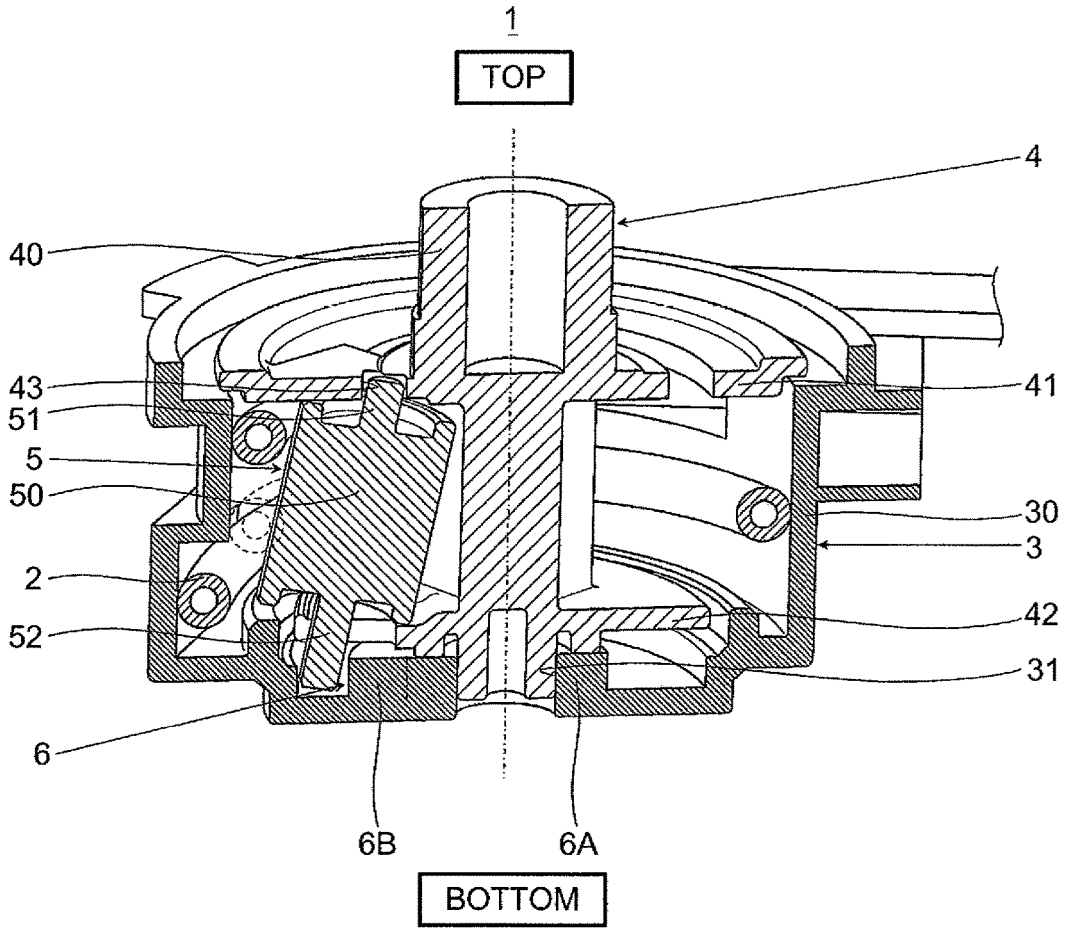
FIG. 1 is a schematic diagram of a rough configuration of a tube pump according to a first embodiment.

Referring now to the drawings, specific examples of embodiments are described below. Throughout the drawings, the same or similar portions are denoted by the same reference symbols and repeated description is omitted. Also throughout the drawings, components needed to describe some embodiments of the invention are selectively illustrated and illustration of other components may be omitted. In addition, the invention is not limited to the embodiments described below.

First Embodiment

Configuration of Tube Pump

Figure 2:
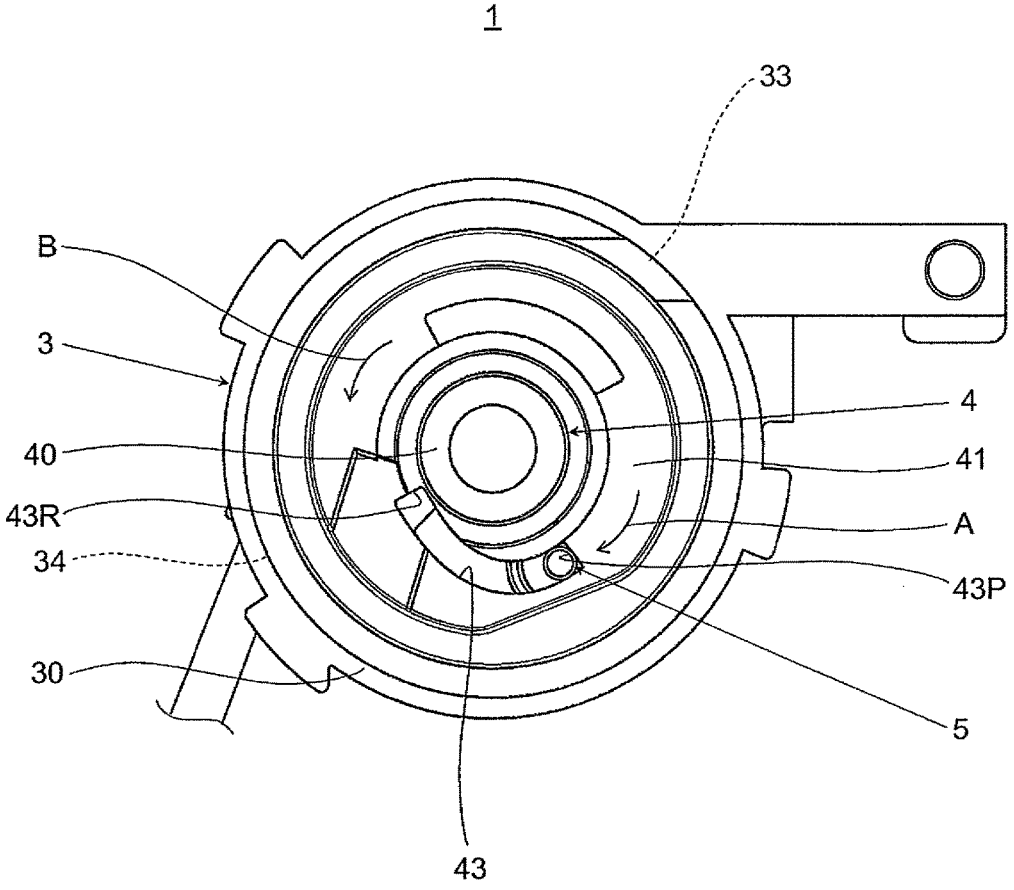
FIG. 2 is a schematic diagram of the tube pump illustrated in FIG. 1 when viewed from above.
Figure 3:
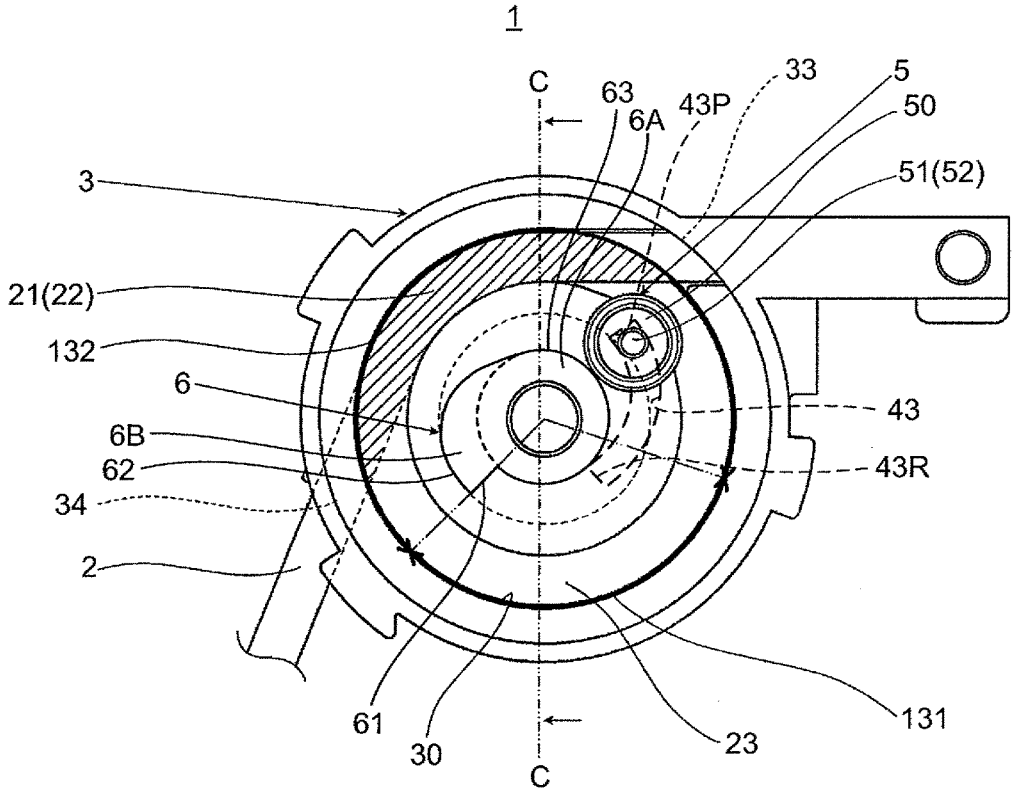
FIG. 3 is a perspective view of the tube pump illustrated in FIG. 1 when viewed from above.
Figure 4:
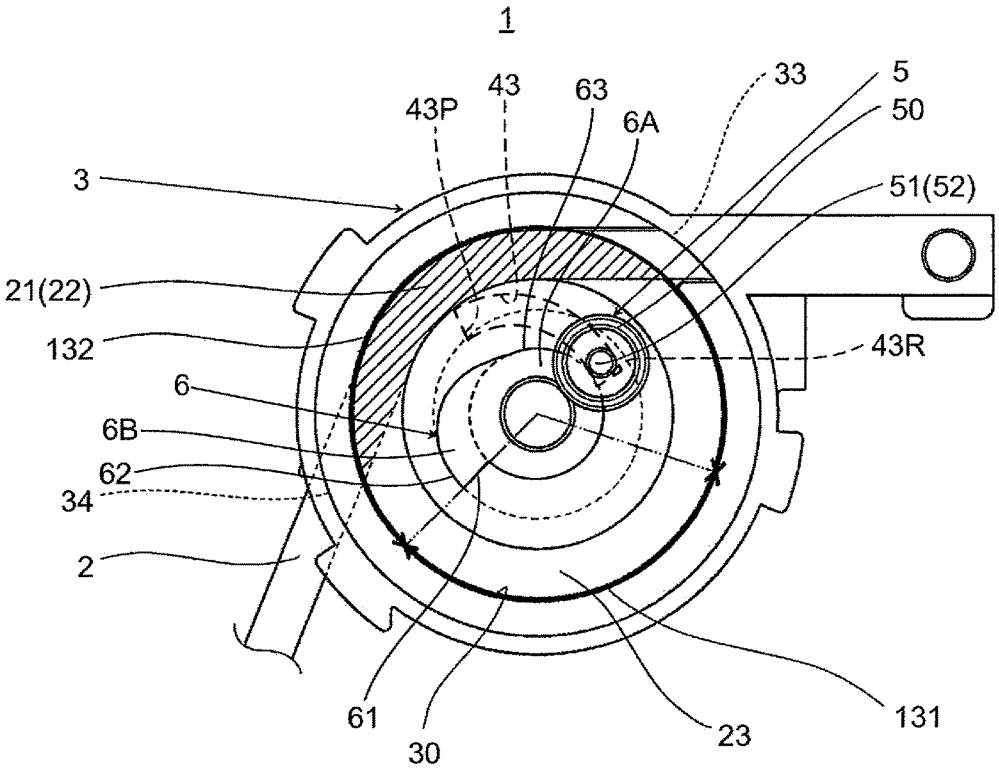
FIG. 4 is a perspective view of the tube pump illustrated in FIG. 1 when viewed from above.
Figure 5:
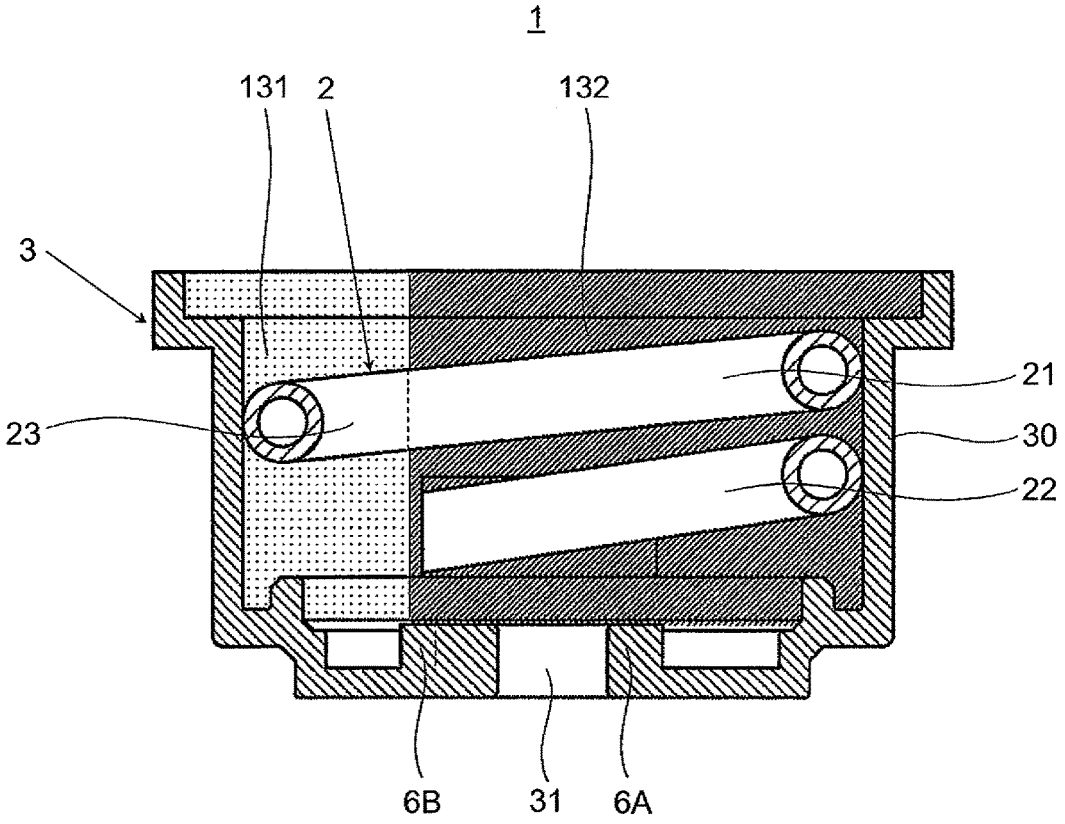
FIG. 5 is a cross-sectional view of the tube pump taken along the line C-C in FIG. 3.
Figure 6A:
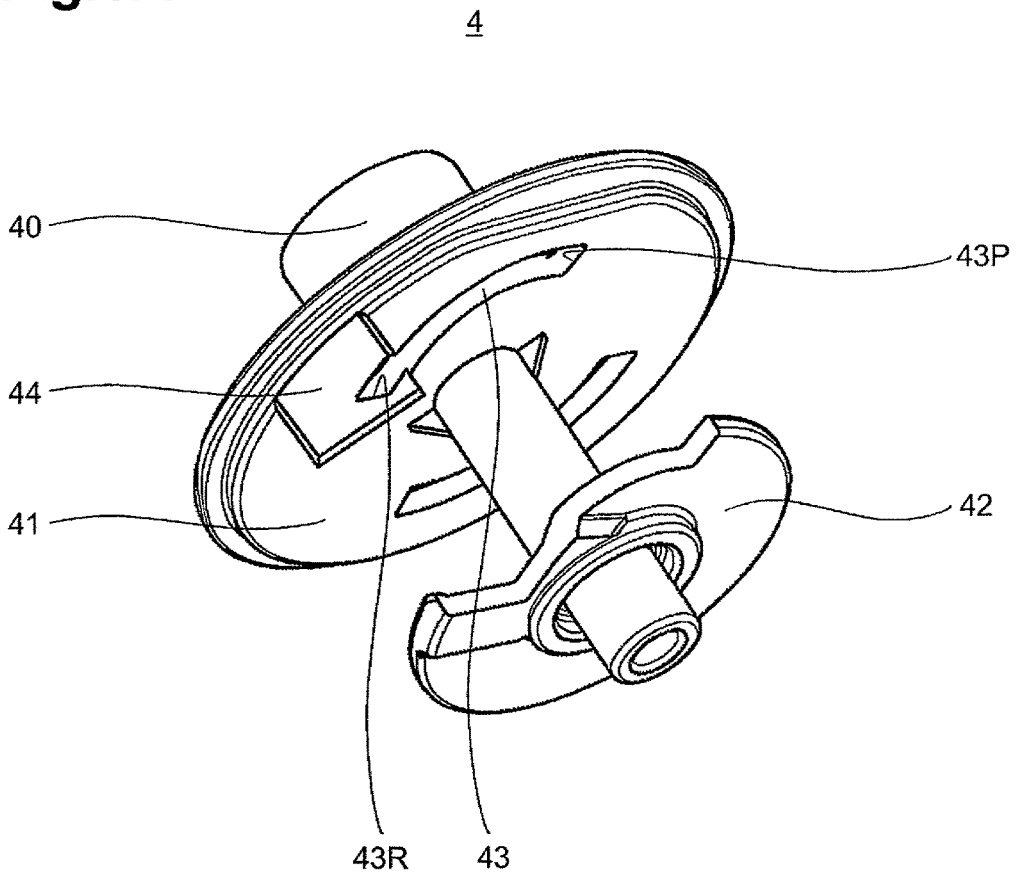
FIG. 6A is a schematic diagram of a rough configuration of a rotatable body of the tube pump illustrated in FIG. 1.
Figure 6B:
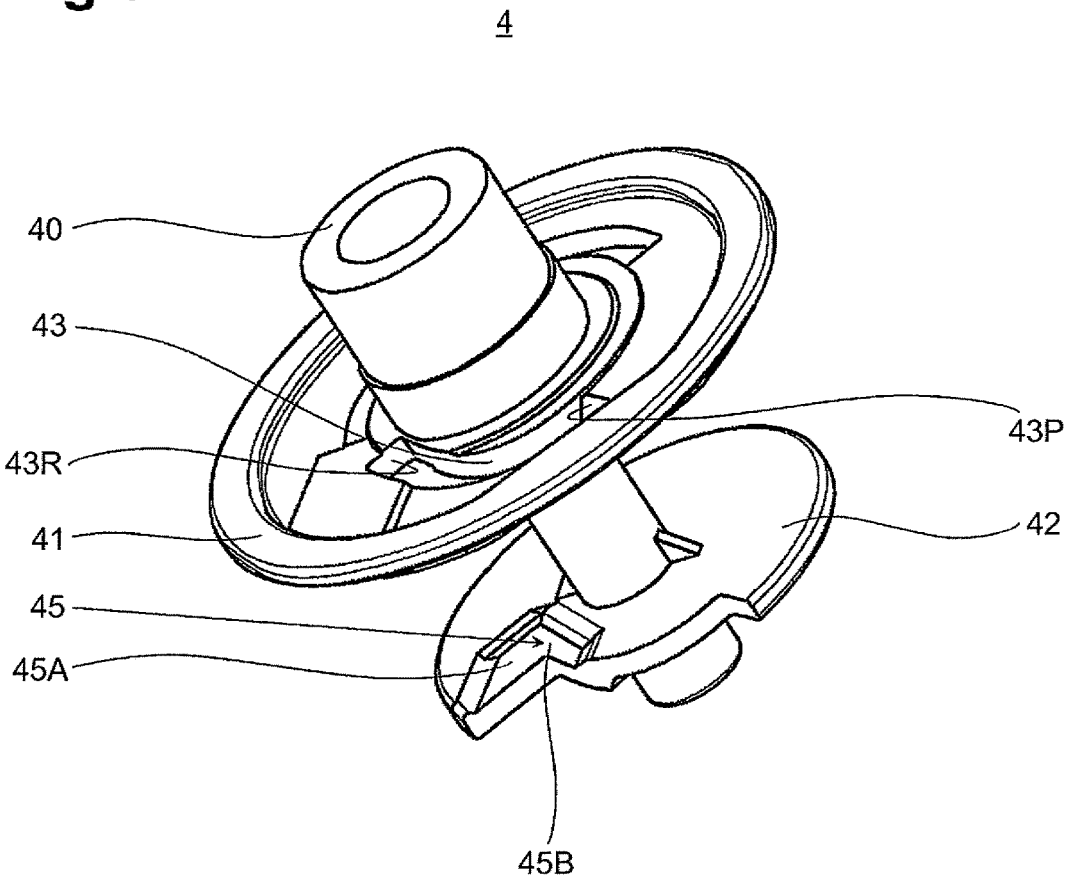
FIG. 6B is a schematic diagram of a rough configuration of a rotatable body of the tube pump illustrated in FIG. 1.

FIG. 1 is a schematic diagram of a rough configuration of a tube pump according to a first embodiment. FIG. 2 is a schematic diagram of the tube pump illustrated in FIG. 1 when viewed from above. FIG. 3 and FIG. 4 are perspective views of the tube pump illustrated in FIG. 1 when viewed from above, where FIG. 3 illustrates the tube pump when a roller is located at a pressing position and FIG. 4 illustrates the tube pump when the roller is located at a release position. FIG. 5 is a cross-sectional view of the tube pump taken along the line C-C in FIG. 3. FIG. 6A and FIG. 6B are schematic diagrams of the rough configuration of a rotatable body of the tube pump illustrated in FIG. 1, where FIG. 6A is a perspective view of the rotatable body when viewed from below and FIG. 6B is a perspective view of the rotatable body when viewed from above.

The expressions top and bottom illustrated in FIG. 1 correspond to the top and the bottom of the tube pump. FIG. 3 and FIG. 4 omit the illustration of a rotatable body and have a hatched portion in which portions of the tube are superposed. FIG. 5 omits the illustration of a rotatable body and a rotor. In FIG. 5, a first area and a second area of an inner peripheral surface are differently hatched.

As illustrated in FIG. 1 to FIG. 6B, a tube pump 1 according to a first embodiment includes a tube 2 through which a fluid flows, a housing member 3 having a cylindrical chamber 30, a rotatable body 4, a roller 5, and a contact member 6. The rotatable body 4 includes a rotation shaft 40. The roller 5 includes a roller body 50, a first roller shank 51, and a second roller shank 52. The tube 2, the rotatable body 4, the roller 5, and the contact member 6 are disposed in the cylindrical chamber 30.

In the tube pump 1, a fluid inside the tube 2 is transported when the roller 5 is revolved around by rotation of the rotatable body 4 while pressing the tube 2.

The cylindrical chamber 30 of the housing member 3 has a recessed shape. The cylindrical chamber 30 is open at one end, which is on the side of one end (first end or upper end) of the rotation shaft 40 in the axial direction. When viewed in the axial direction of the rotation shaft 40 (when viewed from above), a recess (through hole) 31 is formed in a center portion of a bottom surface of the cylindrical chamber 30. The other end (second end or lower end) of the rotation shaft 40 in the axial direction is rotatably disposed in the recess 31.

The rotatable body 4 is driven to rotate around the axis of the rotation shaft 40 by, for example, a motor (not illustrated) for transporting sheets in a printer. The rotatable body 4 further includes a first member 41 disposed at an upper portion of the rotation shaft 40, a second member 42 disposed at a lower portion of the rotation shaft 40, and a guide portion 43 formed in the first member 41.

Referring now to FIG. 6A and FIG. 6B, the configuration of the rotatable body 4 is described in detail.

The first member 41 is formed in a disc shape. When viewed in the axial direction, a helical groove is formed on the main surface of the first member 41. The helical groove is formed so as to be increasingly spaced apart from the rotation shaft 40 in the radial direction as the roller 5 is further revolved in the direction of an arrow B. This helical (arc-shaped) groove serves as the guide portion 43. An end portion (first end portion) of the guide portion 43 closer to the axis of the rotation shaft 40 serves as a release position 43R and the other end portion (second end portion) of the guide portion 43 further from the axis of the rotation shaft 40 serves as a pressing position 43P.

A first recess is formed on the lower-surface outer peripheral portion of the first member 41 around a portion that overlaps the release position 43R of the guide portion 43 when viewed in the axial direction of the rotation shaft 40. The first recess is formed so that part of the lower surface of the first member 41 is recessed upward. The first recess serves as a first clearance 44 that prevents the rotatable body 4 from coming into contact with the roller body 50 of the roller 5, described below.

The first clearance 44 is formed in substantially a rectangle (trapezoid) when viewed in the axial direction of the rotation shaft 40. The length of the first clearance 44 in the radial direction of the first member 41 and the length of first clearance 44 in the circumferential direction of the first member 41 are determined to be greater than the diameter of the roller body 50.

The second member 42 is formed in a disk shape. The second member 42 has a fan-shaped cut portion in the outer peripheral portion of the second member 42, the cut portion overlapping the guide portion 43 when viewed in the axial direction of the rotation shaft 40. A second recess is also formed at an end portion on an upper surface of the second member 42 closer to the release position 43R when viewed in the axial direction of the rotation shaft 40. The second recess is formed so that part of the upper surface of the second member 42 is recessed downward. The second recess serves as a second clearance 45 that prevents the rotatable body 4 from coming into contact with the roller body 50 of the roller 5.

The second clearance 45 is formed in substantially a letter L shape when viewed in the axial direction of the rotation shaft 40. The second clearance 45 includes a first portion 45A, radially extending from the outer periphery of the second member 42, and a second portion 45B, extending along an arc-shaped cut portion on the inner side of the second member 42. The length of the first portion 45A in the radial direction of the second member 42 is determined to be greater than a distance between the outer peripheral surface of the roller body 50 and the outer peripheral surface of the second roller shank 52.

As illustrated in FIG. 2, the first roller shank 51 of the roller 5 is fitted into the guide portion 43 so as to be rotatable and swingable. As described above, the roller 5 includes the cylindrical roller body 50, the first roller shank 51 disposed on the upper surface of the roller body 50, and the second roller shank (shank member) 52 disposed on the lower surface of the roller body 50.

The roller 5 is so formed that the centers (axes) of the roller body 50, the first roller shank 51, and the second roller shank 52 are coaxial with one another. As described below, the roller 5 is arranged so that its center extends substantially parallel to the axis of the rotation shaft 40 unless the roller 5 changes its orientation as a result of the second roller shank 52 coming into contact with the second contact portion 62 of the contact member 6.

The roller body 50 has a dimension in the axial direction of the roller body 50 (height) that is smaller than a distance between the first member 41 and the second member 42 of the rotatable body 4 in the axial direction of the rotation shaft 40. The roller 5 is disposed so that the roller body 50 is located between the first member 41 and the second member 42 in the axial direction of the rotation shaft 40.

The contact member 6 is disposed on the bottom surface of the cylindrical chamber 30 of the housing member 3 around the opening of the recess 31 when viewed in the axial direction of the rotation shaft 40. The contact member 6 is endlessly continuous in the rotation direction of the roller 5. The contact member 6 has a circumferential wall surface that can come into contact with the second roller shank 52. The circumferential wall surface includes a first wall surface, a second wall surface, and a third wall surface 63 that connects the first wall surface and the second wall surface together. The third wall surface 63 is radially equidistantly spaced from the rotation shaft 40. When the roller 5 is revolved at the release position 43R, the third wall surface 63 faces the second roller shank 52 (comes into contact with the second roller shank 52) in the radial direction.

Specifically, the contact member 6 includes an annular first contact member 6A and a second contact member 6B shaped so as to protrude outward from the outer peripheral surface of the first contact member 6A. The inner peripheral surface of the first contact member 6A is formed so as to coincide with the opening of the recess 31. The outer peripheral surface of the first contact member 6A serves as the third wall surface 63. The third wall surface 63 is formed so as to coincide with the revolution orbit of the second roller shank 52 (more precisely, the portion closest to the rotation shaft 40) when the roller 5 is located at the release position 43R.

In the first embodiment, the contact member 6 is in the form in which it is integrated with the bottom surface of the cylindrical chamber 30. However, the form of the contact member 6 is not limited to this form. The contact member 6 may be in other forms in which it is provided separate from the bottom surface of the cylindrical chamber 30.

The second contact member 6B includes a first contact portion 61 and a second contact portion 62. When the roller 5 is revolved in the direction of an arrow A (first direction) illustrated in FIG. 2, the first contact portion 61 comes into contact with a lower end portion (second end portion of the roller 5) of the second roller shank 52 of the roller 5 at the release position 43R so as to move the roller 5 to the pressing position 43P along the guide portion 43. In the first embodiment, the second end portion of the roller 5 is a concept including a portion of the roller 5 below the center in the axial direction of the rotation shaft 40 and is not limited to the lower end portion of the second roller shank 52.

Specifically, the first contact portion 61 is constituted of a flat first wall surface, which extends so as to connect a point on the revolution orbit of the roller 5 (here, the portion of the second roller shank 52 closest to the rotation shaft 40) at the release position 43R to a point on the revolution orbit of the roller 5 (here, the portion of the second roller shank 52 closest to the rotation shaft 40) at the pressing position 43P. In the first embodiment, the first contact portion 61 is in the form of a flat surface, but the first contact portion 61 is not limited to this form. The first contact portion 61 may be in any form, for example, in the form of a curved surface, as long as it can cause the roller 5 located at the release position 43R to move to the pressing position 43P along the guide portion 43 when the rotatable body 4 rotates in the direction of an arrow A.

The second contact portion 62 causes the roller 5 to change its orientation and to pass by the first contact portion 61 by coming into contact with the lower end portion of the second roller shank 52 when the roller 5 is revolved in a direction of an arrow B (second direction), which is opposite to the direction of an arrow A, so that the roller 5 is revolved at the release position 43R.

Specifically, the second contact portion 62 is constituted of a curved second wall surface that causes the roller 5 to tilt in such a manner that, as the roller 5 is further revolved in the direction of an arrow B, the lower end portion of the second roller shank 52 extends so as to be increasingly spaced apart from the rotation shaft 40 in the radial direction of the roller 5 than the upper end portion of the first roller shank 51 (first end portion of the roller 5). More specifically, the second contact portion 62 is connected to the outer peripheral surface of the first contact member 6A at its starting end and to the outer end portion of the first contact portion 61 at its terminal end. When viewed in the axial direction of the rotation shaft 40, the second contact portion 62 is shaped in an arc (logarithmic spiral).

In the first embodiment, the first end portion of the roller 5 is a concept including a portion of the roller 5 above the center in the axial direction of the rotation shaft 40 and is not limited to the upper end portion of the first roller shank 51. In the first embodiment, the second contact portion 62 is in the form of a curved surface but is not limited to this form. The second contact portion 62 may be in any form, for example, in the form of a polygon, as long as it can change the orientation of the roller 5 as the roller 5 is further revolved in the direction of an arrow B.

As illustrated in FIG. 2 to FIG. 4, two through holes 33 and 34 are formed on an outer peripheral surface of the housing member 3. The tube 2 is inserted through these through holes 33 and 34 and disposed so as to extend round along the inner peripheral surface of the cylindrical chamber 30 (so as to encircle the rotation shaft 40).

Referring now to FIG. 2 to FIG. 5, the positional relationship between the tube 2 and the inner peripheral surface of the cylindrical chamber 30 is described in detail.

Firstly, the inner peripheral surface of the cylindrical chamber 30 is described.

As illustrated in FIG. 3 to FIG. 5, the inner peripheral surface of the cylindrical chamber 30 includes a first area 131 and a second area 132. The first area 131 is an area corresponding to the second contact portion 62 of the contact member 6 in the radial direction of the cylindrical chamber 30. The second area 132 is an area extending from one end to the other end of the first area in the rotation direction of the roller 5 (the direction of an arrow B illustrated in FIG. 2).

In other words, the first area 131 is an area of the inner peripheral surface of the cylindrical chamber 30, the area facing the second contact portion 62, when viewed in the radial direction of the cylindrical chamber 30. The second area 132 is an area of the inner peripheral surface of the cylindrical chamber 30 other than the first area 131.

In the first embodiment, the inner peripheral surface of the cylindrical chamber 30 includes the first area 131 and the second area 132, but the inner peripheral surface of the cylindrical chamber 30 is not limited to this form. The inner peripheral surface of the cylindrical chamber 30 may include areas other than these areas.

Subsequently, the positional relationship between the tube 2 and the inner peripheral surface of the cylindrical chamber 30 is described.

The tube 2 is disposed inside the cylindrical chamber 30 so as to coil into a letter α shape when viewed in the axial direction of the rotatable body 4 (see FIG. 3 and FIG. 4). The tube 2 is disposed so that the first portion 21 and the second portion 22, which cross each other, correspond (face) the second area 132 on the inner peripheral surface of the cylindrical chamber 30 when viewed in the radial direction of the cylindrical chamber 30. The first portion 21 and the second portion 22 are disposed so as to be arranged adjacent to each other (superposed) in the axial direction. Specifically, when viewed in the axial direction of the rotation shaft 40, the first portion 21 and the second portion 22 are superposed.

The tube 2 is disposed so that a portion 23 of the tube 2 on the inner peripheral surface of the cylindrical chamber 30 corresponding to (facing) the first area 131 when viewed in the radial direction of the cylindrical chamber 30 is located closer to the opening of the cylindrical chamber 30 rather than the bottom surface of the cylindrical chamber 30.

In the first embodiment, the tube 2 is disposed inside the cylindrical chamber 30 so as to coil into a letter α shape but the tube 2 is not limited to this form. For example, the tube 2 may be disposed inside the cylindrical chamber 30 in the form of a letter U shape.

Operation of Tube Pump

Referring now to FIG. 1 to FIG. 6B, the operation of a tube pump according to a first embodiment is described.

Sucking Operation of Tube Pump

Firstly, a sucking operation of the tube pump 1 is described.

As illustrated in FIG. 2 and FIG. 3, a case is assumed where the roller 5 is located at the pressing position 43P of the guide portion 43 and the rotatable body 4 is rotated by a motor, not illustrated, in the direction of an arrow A. In this case, the roller 5 is revolved in the direction of an arrow A in accordance with the rotation of the rotatable body 4 since the upper end portion of the first roller shank 51 is in contact with a second end of the guide portion 43 serving as the pressing position 43P.

The roller 5 is thus revolved while successively pressing the tube 2. The tube 2 is pressed between the roller 5 (roller body 50) and the inner peripheral surface of the cylindrical chamber 30 and a fluid such as ink is sucked into the tube 2 from a first end of the tube 2. In response to the revolution of the roller 5, the fluid in the tube 2 is pressed and transported outward and then ejected from a second end of the tube 2.

Operation of Moving Roller from Pressing Position to Release Position

The following describes an operation performed when the roller 5 is moved from the pressing position 43P to the release position 43R.

Firstly, a case is assumed where the rotatable body 4 rotates in the direction of an arrow B when the roller 5 is located at the pressing position 43P of the guide portion 43. Then, the upper end portion of the first roller shank 51 is no longer allowed to be revolved by the rotation of the rotatable body 4 since the upper end portion of the first roller shank 51 becomes separated from the second end portion of the guide portion 43. Thus, only the rotatable body 4 rotates.

At this time, the upper end portion of the first roller shank 51 is in contact with the side surface of the groove serving as the guide portion 43 and the roller body 50 is in contact with the tube 2. Thus, the roller 5 (first roller shank 51) is moved to the release position 43R along the guide portion 43 by the rotation of the rotatable body 4. In this manner, the roller 5 moves from the pressing position 43P to the release position 43R.

Operation of Revolving Roller at Release Position

Subsequently, an operation of revolving the roller 5 at the release position 43R is described.

As described above, when the roller 5 (first roller shank 51) arrives at the release position 43R, the upper end portion of the first roller shank 51 comes into contact with the first end portion of the guide portion 43. Thus, the roller 5 is revolved in the direction of an arrow B by the rotation of the rotatable body 4. Here, the roller 5 is revolved at the release position 43R at which the roller 5 is not in contact with the tube 2. Thus, the tube 2 is released from pressure.

When the roller 5 arrives at the starting end of the second contact portion 62 of the contact member 6 while being revolved at the release position 43R, the lower end portion of the second roller shank 52 and the starting end of the second contact portion 62 come into contact with each other and the lower end portion of the second roller shank 52 starts being revolved along the second contact portion 62. On the other hand, the first roller shank 51 of the roller 5 is revolved at the release position 43R. Thus, the roller 5 is revolved while changing its orientation. Specifically, the roller 5 is revolved while tilting in such a manner that the lower end portion of the roller 5 is further spaced apart from the rotation shaft 40 in the radial direction of the roller 5 than the upper end portion of the roller 5.

Here, as illustrated in FIG. 6A, the first clearance 44 is formed on the lower surface of the first member 41 so as to be recessed upward. This first clearance 44 prevents an upper portion of the roller body 50 and the lower surface of the first member 41 from coming into contact with each other when the roller 5 tilts, whereby the roller 5 is allowed to tilt easily.

If the tube 2 is located at a lower portion of the cylindrical chamber 30 as drawn with the dotted lines in FIG. 1, the tube 2 would come into contact with the roller body 50 and would be pressed by the roller body 50 due to tilting of the roller 5. In the first embodiment, however, the portion 23 of the tube 2 is located at an upper portion of the cylindrical chamber 30 as illustrated in FIG. 5. Thus, the tube 2 and the roller body 50 are prevented from coming into contact with each other when the roller 5 tilts. The fluid inside the tube 2 is thus prevented from flowing backward.

When the roller 5 (second roller shank 52) arrives at the terminal end of the second contact portion 62, the lower end portion of the second roller shank 52 becomes separated from the second contact portion 62 and passes by the first contact portion 61.

Here, as illustrated in FIG. 6B, the second clearance 45 is formed on the upper surface of the second member 42 so as to be recessed downward. This second clearance 45 prevents a lower portion of the roller body 50 and the second member 42 from coming into contact with each other when the roller 5 passes by the first contact portion 61. In addition, the area of the second member 42 over which the second member 42 comes into contact with the second roller shank 52 can be minimized. Thus, an impulsive sound that occurs when the roller 5 and the second member 42 come into contact with each other can be reduced.

After the roller 5 passes by the first contact portion 61, the second roller shank 52 returns to the release position 43R and the roller 5 is revolved after returning to the orientation parallel to the axial direction of the rotation shaft 40.

Operation of Moving Roller from Release Position to Pressing Position

Firstly, a case is assumed where the rotatable body 4 rotates in the direction of an arrow A when the roller 5 is located at the release position 43R of the guide portion 43. The upper end portion of the first roller shank 51 of the roller 5 is in contact with the side surface of the groove, serving as the guide portion 43, and the roller body 50 is separated from the tube 2. Thus, the roller 5 is revolved in the direction of an arrow A by the rotation of the rotatable body 4 until the lower end portion of the second roller shank 52 comes into contact with the first contact portion 61 of the contact member 6.

When the lower end portion of the second roller shank 52 comes into contact with the first contact portion 61 of the contact member 6, the roller 5 is hindered from moving (revolving) in the direction of an arrow A by the first contact portion 61. On the other hand, the first roller shank 51 is moved to the pressing position 43P along the guide portion 43 since the rotatable body 4 is rotating in the direction of an arrow A. Thus, the roller 5 is moved toward the outer end portion of the first contact portion 61.

When the roller 5 (first roller shank 51) arrives at the pressing position 43P, the second roller shank 52 becomes separated from the first contact portion 61, the upper end portion of the first roller shank 51 comes into contact with the second end portion of the guide portion 43, and the roller body 50 comes into contact with the tube 2. Thus, the roller 5 is revolved in the direction of an arrow A by the rotation of the rotatable body 4.

The tube pump 1 according to the first embodiment having the above-described configuration includes a contact member 6 including the first contact portion 61 and the second contact portion 62. When the roller 5 is revolved in the first direction, the first contact portion 61 comes into contact with the second end portion of the roller 5 at the release position 43R and moves the roller 5 to the pressing position 43P along the guide portion 43. When the roller 5 is revolved in the second direction, the second contact portion 62 comes into contact with the second end portion of the roller 5, changes the orientation of the roller 5, and causes the roller 5 to pass by the first contact portion 61 so that the roller 5 is revolved at the release position 43R.

Specifically, the first contact portion 61 is constituted of a first wall surface. The first wall surface extends so as to connect a point on the revolution orbit of the roller 5 at the release position 43R to a point on the revolution orbit of the roller 5 at the pressing position 43P so as to hinder the roller 5 from revolving in the first direction. The second contact portion 62 is constituted of a second wall surface. The second wall surface causes the roller 5 to tilt so that the second end portion of the roller 5 is further spaced apart from the rotation shaft 40 in the radial direction than the first end portion of the roller 5 as the roller 5 is further revolved in the second direction.

Thus, the roller 5 changes its orientation when the second end portion of the roller 5 comes into contact with the contact member 6, whereby the contact member 6 is prevented from being deformed. Thus, deterioration of the contact member 6 can be more sufficiently minimized than that in the case of a guide member in the above-described existing tube pump, whereby impairment of the pump performance can be minimized.

In addition, the roller 5 is allowed to move between the pressing position 43P and the release position 43R as a result of the second end portion of the roller 5 coming into contact with the contact member 6, whereby the roller 5 is not required to constantly keep in contact with the tube 2. The tube 2 is thus allowed to be fully released. Deterioration of the tube 2 is further minimized than in the case of the existing technology that requires the roller 5 to constantly keep in contact with the tube 2.

Since the roller 5 is not required to constantly keep in contact with the tube 2, grease can be applied to a portion between the roller 5 and the tube 2, whereby the torque reduction can be minimized and the tube durability can be increased.

In the tube pump 1 according to the first embodiment, the cylindrical chamber 30 is formed in the housing member 3 so as to be recessed. The inner peripheral surface of the cylindrical chamber 30 includes a first area 131 corresponding to the second contact portion 62 in the radial direction. The tube 2 includes the portion 23 corresponding to the first area 131. The contact member 6 is disposed on the bottom surface of the cylindrical chamber 30. The portion 23 of the tube 2 corresponding to the first area 131 is located closer, in the axial direction, to the opening of the cylindrical chamber 30 rather than the bottom surface.

This configuration prevents, when the roller 5 tilts, an end portion of the roller 5 from coming into contact with the tube 2 (portion 23 of the tube 2) located in the first area 131 of the inner peripheral surface of the cylindrical chamber 30. Thus, the fluid in the tube 2 is prevented from flowing backward.

In the tube pump 1 according to the first embodiment, the inner peripheral surface of the cylindrical chamber 30 further includes a second area 132 that extends in the rotation direction of the roller 5 from one end to the other end of the first area 131. The tube 2 includes a first portion 21 and a second portion 22 adjacent to the first portion 21 in the axial direction. The first portion 21 and the second portion 22 are disposed in an area corresponding to the second area 132.

This configuration prevents one end portion of the roller 5 from coming into contact with the first portion 21 and the second portion 22 of the tube 2 when the roller 5 tilts. Thus, a fluid inside the tube 2 is prevented from flowing backward.

In the tube pump 1 according to the first embodiment, the rotatable body 4 further includes the second member 42 disposed at the second end portion of the rotation shaft 40. The roller 5 is disposed so that the roller body 50 is located between the first member 41 and the second member 42. The first clearance 44 is formed in the first member 41 so as to increase the distance between the first member 41 and the second member 42 in the axial direction than the other portion of the first member 41.

This configuration prevents an upper portion of the roller body 50 from coming into contact with the lower surface of the first member 41 when the roller 5 tilts, whereby the roller 5 is allowed to tilt easily.

In addition, in the tube pump 1 according to the first embodiment, the rotatable body 4 also includes the second member 42 disposed at the second end portion of the rotation shaft 40. The roller 5 is disposed so that the roller body 50 is located between the first member 41 and the second member 42. The second clearance 45 is formed in the second member 42 so as to increase the distance between the first member 41 and the second member 42 in the axial direction than the other portion of the second member 42.

This configuration prevents, when the roller 5 passes by the first contact portion 61, a lower portion of the roller body 50 from coming into contact with the second member 42. In addition, the area of the second member 42 over which the second member 42 comes into contact with the second roller shank 52 can be minimized. Thus, an impulsive sound that occurs when the roller 5 and the second member 42 come into contact with each other can be reduced.

Second Embodiment

Configuration of Tube Pump

Figure 7:
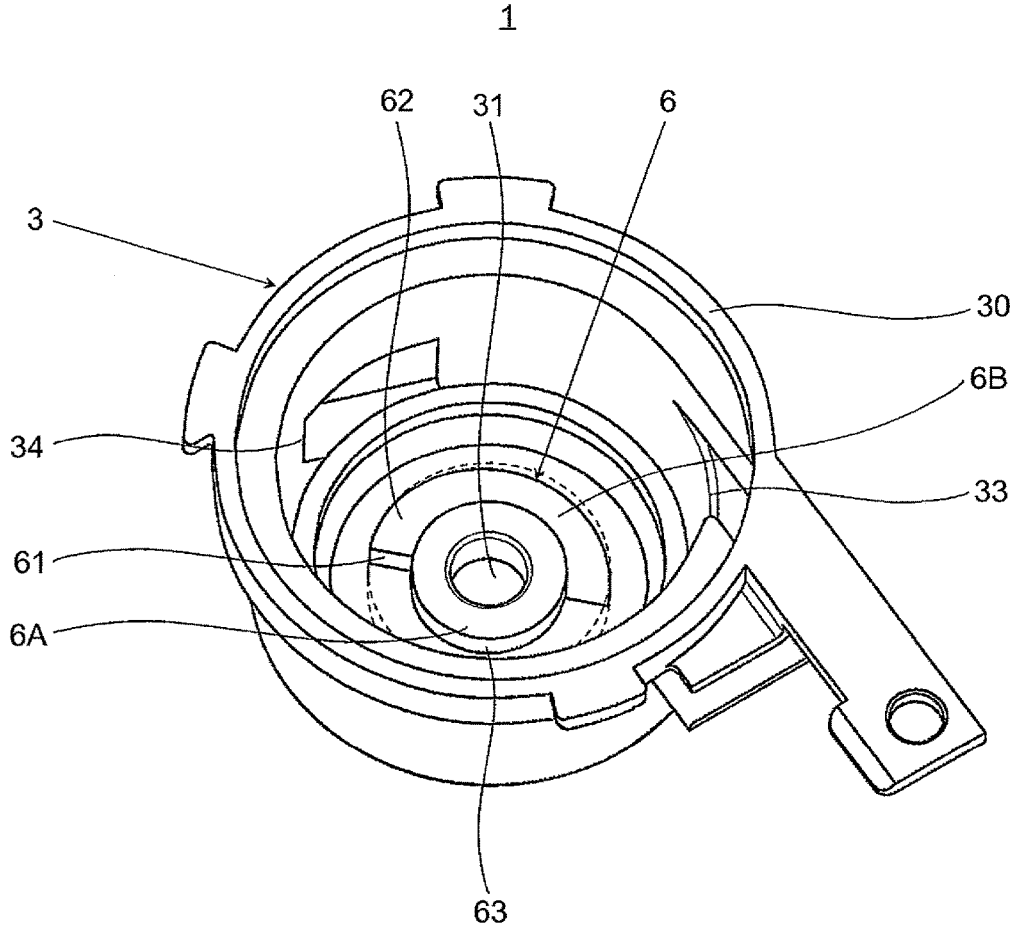
FIG. 7 is a schematic diagram of a rough configuration of a tube pump according to a second embodiment.

FIG. 7 is a schematic diagram of a rough configuration of a tube pump according to a second embodiment. FIG. 7 omits illustrations of the rotatable body and the roller.

As illustrated in FIG. 7, a tube pump 1 according to a second embodiment has a fundamental configuration substantially the same as that of the tube pump 1 according to the first embodiment except for the configuration of the second contact portion 62 of the contact member 6. Specifically, the second contact portion 62 is constituted of a surface so tilted that the roller 5 moves in a direction extending from the second end portion of the roller 5 to the first end portion of the roller 5 as the roller 5 is revolved further in the second direction (the direction of an arrow B illustrated in FIG. 2).

More specifically, the second contact portion 62 is formed in a fan shape when viewed in the axial direction of the rotation shaft 40. The second contact portion 62 has its starting end connected to the outer peripheral surface of the first contact member 6A and its terminal end connected to the first contact portion 61. The second contact portion 62 has an upper surface constituted of a tilted surface, which is tilted increasingly upward with increasing distance in the second direction.

Operation of Tube Pump

Subsequently, the operation of the tube pump 1 according to the second embodiment is described. The operations of the tube pump 1 other than the operation of revolving the roller 5 at the release position 43R are the same as those of the tube pump 1 according to the first embodiment and thus those operations are not described in detail here.

When the roller 5 arrives at the starting end of the second contact portion 62 of the contact member 6 while being revolved at the release position 43R, the lower end of the second roller shank 52 moves so as to climb up the tilted surface serving as the second contact portion 62. On the other hand, the roller 5 is revolved in the direction of an arrow B by the rotation of the rotatable body 4 (in synchronization with rotation of the rotatable body 4) since the upper end portion of the first roller shank 51 is in contact with the first end portion of the guide portion 43.

Thus, the roller 5 is revolved while changing its orientation so as to tilt forward and backward (with the upper end portion of the roller 5 to the front and the lower end portion of the roller 5 to the back) with respect to the revolution direction (direction of an arrow B).

When the roller 5 (second roller shank 52) arrives at the terminal end of the second contact portion 62, the lower end of the second roller shank 52 becomes separated from the second contact portion 62 and passes by the first contact portion 61. When the roller 5 passes by the first contact portion 61, the roller 5 is revolved after returning to the orientation parallel to the axial direction of the rotation shaft 40.

In the tube pump 1 according to the second embodiment having the above-described configuration, the first contact portion 61 is constituted of a first wall surface extending so as to connect a point on the revolution orbit of the roller 5 at the release position 43R to a point on the revolution orbit of the roller 5 at the pressing position 43P so as to hinder the roller 5 from revolving in the first direction. The second contact portion 62 is constituted of a surface tilted so that the roller 5 moves further in the direction extending from the second end portion of the roller 5 to the first end portion of the roller 5 as the roller 5 is revolved further in the second direction.

Thus, the contact member 6 is prevented from being deformed since the orientation of the roller 5 is changed as a result of the second end portion of the roller 5 coming into contact with the contact member 6. Thus, deterioration of the contact member 6 is more sufficiently minimized than in the case of a guide member in the above-described existing tube pump, whereby impairment of the pump performance can be minimized.

In addition, the roller 5 is allowed to move between the pressing position 43P and the release position 43R as a result of the second end portion of the roller 5 coming into contact with the contact member 6, whereby the roller 5 is not required to constantly keep in contact with the tube 2. The tube 2 is thus allowed to be fully released. Deterioration of the tube 2 is further minimized than in the case of the existing technology that requires the roller 5 to constantly keep in contact with the tube 2.

Since the roller 5 is not required to constantly keep in contact with the tube 2, grease can be applied to a portion between the roller 5 and the tube 2, whereby the torque reduction can be minimized and the tube durability can be increased.

Third Embodiment

Configuration of Tube Pump

Figure 8:
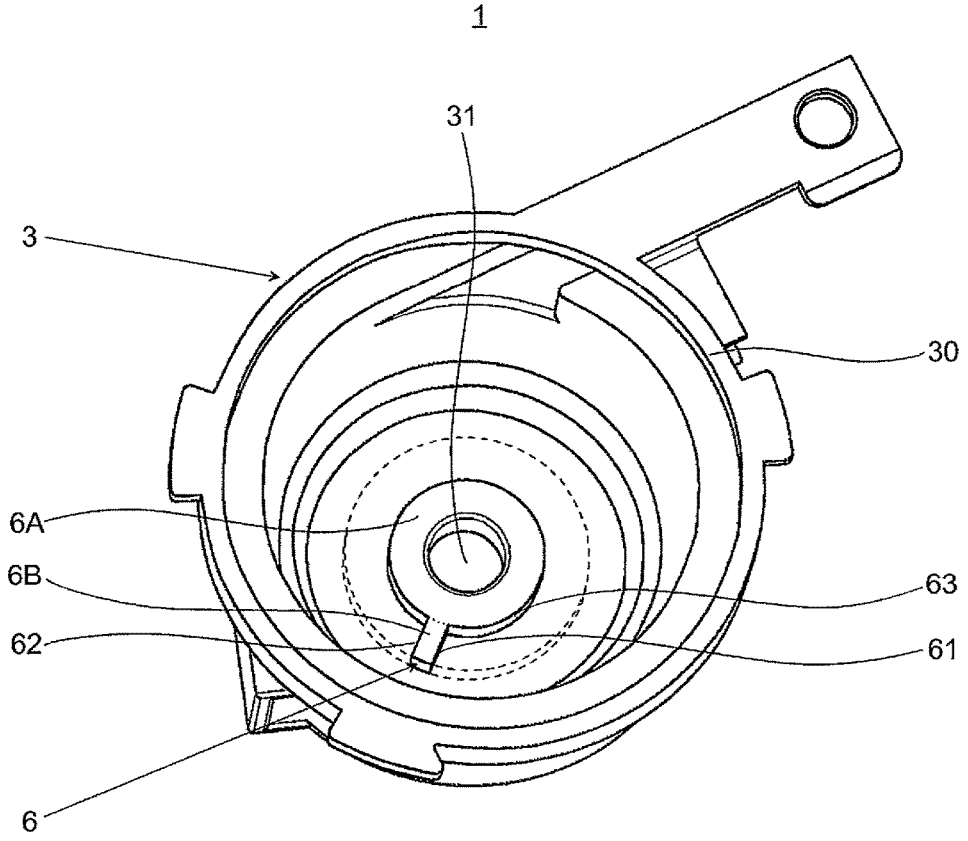
FIG. 8 is a schematic diagram of a rough configuration of a tube pump according to a third embodiment.

FIG. 8 is a schematic diagram of a rough configuration of a tube pump according to a third embodiment. FIG. 8 omits the illustrations of the rotatable body and the roller.

As illustrated in FIG. 8, a tube pump 1 according to a third embodiment has a fundamental configuration substantially the same as that of the tube pump 1 according to the first embodiment except for the configuration of the contact member 6. Specifically, the contact member 6 has two surfaces that cross the revolution direction of the roller 5, the first contact portion 61 is constituted of one of the surfaces of the contact member 6, and the second contact portion 62 is constituted of the other surface of the contact member 6.

More specifically, the contact member 6 is constituted of a plate member extending so as to connect a point on the revolution orbit of the roller 5 (here, the inner end surface of the second roller shank 52) at the release position 43R to a point on the revolution orbit of the roller 5 (here, the inner end surface of the second roller shank 52) at the pressing position 43P. The first contact portion 61 is constituted of one main surface of the plate member and the second contact portion 62 is constituted of the other main surface of the plate member.

Operation of Tube Pump

Subsequently, the operation of the tube pump 1 according to the third embodiment is described. Here, the operations other than the revolving operation of the roller 5 at the release position 43R are similar to those in the case of the tube pump 1 according to the first embodiment and thus are not described in detail here.

When the roller 5 arrives at the second contact portion 62 of the contact member 6 while being revolved at the release position 43R in the direction of an arrow B illustrated in FIG.

2, the lower end portion of the second roller shank 52 comes into contact with the main surface serving as the second contact portion 62, so that the second end portion of the roller 5 is hindered from moving in the direction of an arrow B. On the other hand, the first end portion of the roller 5 is revolved in the direction of an arrow B by the rotation of the rotatable body 4 (in synchronization with rotation of the rotatable body 4) since the upper end portion of the first roller shank 51 is in contact with one end portion of the guide portion 43.

Thus, the orientation of the roller 5 is changed so as to tilt forward and backward (with the upper end portion of the roller 5 to the front and the lower end portion of the roller 5 to the back) with respect to the revolution direction (direction of an arrow B).

When the roller 5 tilts forward and backward to a large degree, the distance between the upper end of the first roller shank 51 and the lower end of the second roller shank 52 increases and the lower end of the second roller shank 52 climbs over the second contact portion 62 and passes by the first contact portion 61. When the roller 5 passes by the first contact portion 61, the roller 5 is revolved after returning to the orientation parallel to the axial direction of the rotation shaft 40.

In the tube pump 1 according to the third embodiment having the above-described configuration, the contact member 6 has two surfaces that cross the revolution direction of the roller 5. The first contact portion 61 is constituted of one of the surfaces of the contact member 6 and the second contact portion 62 is constituted of the other surface of the contact member 6.

Thus, the contact member 6 is prevented from being deformed since the orientation of the roller 5 is changed as a result of the second end portion of the roller 5 coming into contact with the contact member 6. Thus, deterioration of the contact member 6 is more sufficiently minimized than in the case of the guide member in the above-described existing tube pump, whereby impairment of the pump performance can be minimized.

Since the roller 5 is allowed to move between the pressing position 43P and the release position 43R as a result of the second end portion of the roller 5 coming into contact with the contact member 6, the roller 5 is not required to constantly keep in contact with the tube 2. The tube 2 is thus allowed to be fully released. Deterioration of the tube 2 is further minimized than in the case of the existing technology that requires the roller 5 to constantly keep in contact with the tube 2.

Since the roller 5 is not required to constantly keep in contact with the tube 2, grease can be applied to a portion between the roller 5 and the tube 2, whereby the torque reduction can be minimized and the tube durability can be increased.

Fourth Embodiment

Configuration of Printer

Figure 9:
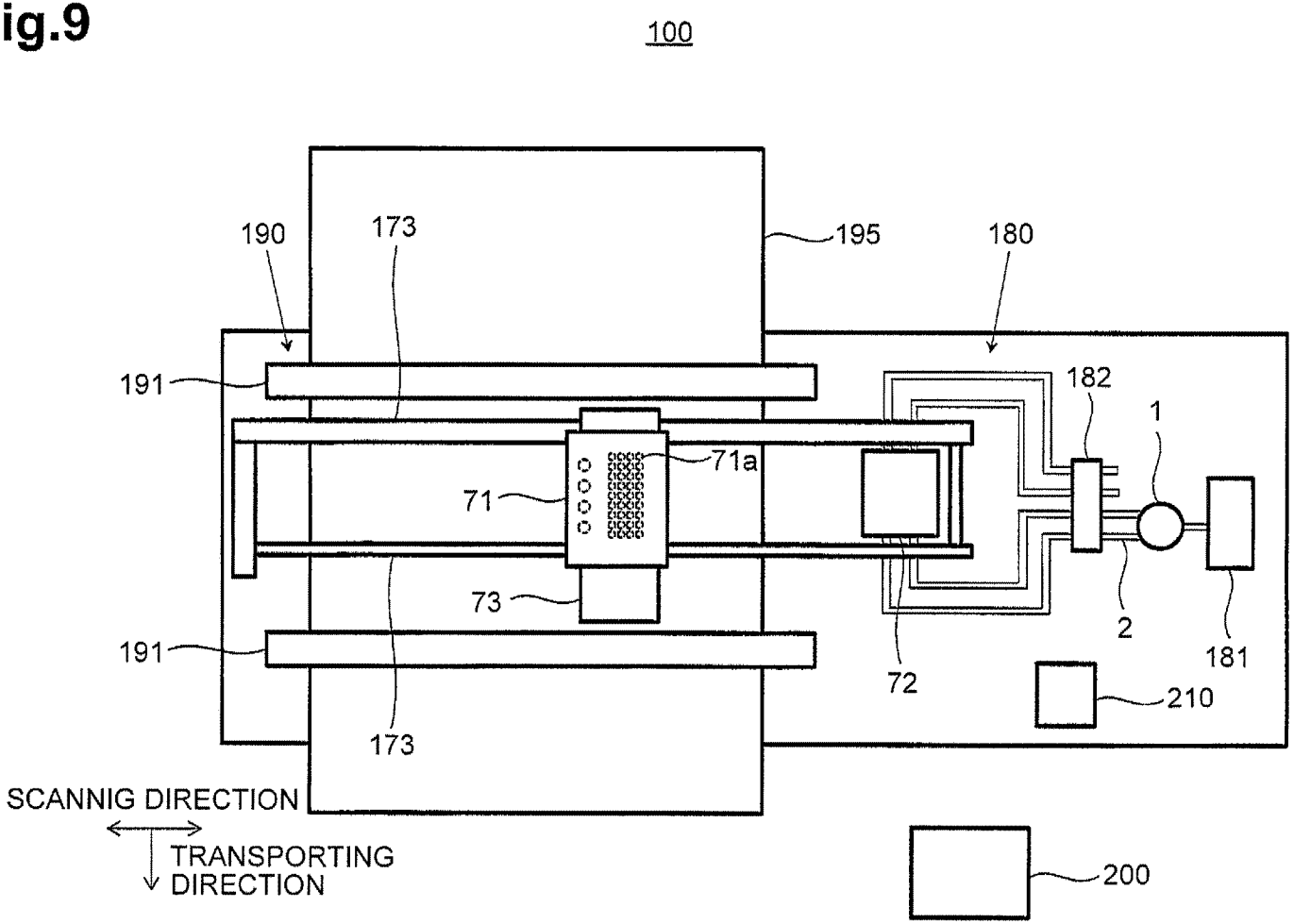
FIG. 9 is a schematic diagram of a rough configuration of a printer according to a fourth embodiment.
Figure 10:
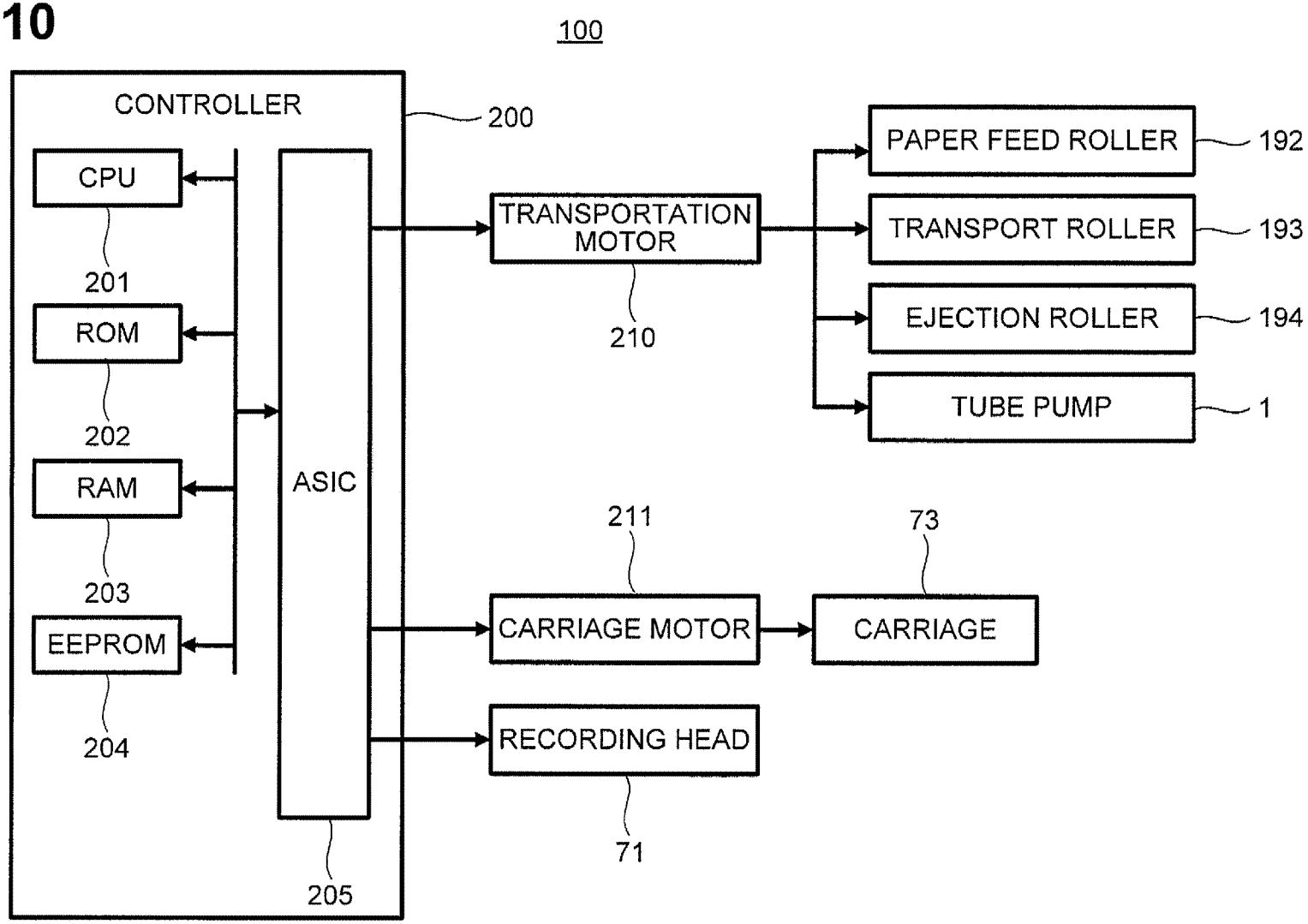
FIG. 10 is a block diagram of a functional configuration of the printer illustrated in FIG. 9.

FIG. 9 is a schematic diagram of a rough configuration of a printer according to a fourth embodiment. FIG. 10 is a block diagram of a functional configuration of the printer illustrated in FIG. 9.

As illustrated in FIG. 9 and FIG. 10, a printer 100 according to a fourth embodiment includes the tube pump 1 according to the first embodiment, a transportation motor 210 serving as an example of a driving device, and a controller 200. The controller 200 controls the transportation motor 210 so that the transportation motor 210 rotates the rotatable body 4 in such a manner as to revolve the roller 5 at least once around the rotation shaft 40 when the roller 5 is moved from the pressing position 43P to the release position 43R.

The printer 100 according to the fourth embodiment includes a recording head 71, a cap 72, a carriage 73, a maintenance unit 180, and a transporting mechanism 190. The printer 100 prints an image on a sheet 195 transported (supplied) by the transporting mechanism 190 from a paper feed tray, not illustrated, and ejects the sheet 195, on which the image has been printed, by the transporting mechanism 190 to an ejection tray (not illustrated).

The carriage 73 is driven by a carriage motor 211 so as to reciprocate the recording head 71 in a scan direction. Specifically, the carriage 73 is supported by a pair of guide rails 173 disposed so as to extend in the scan direction. The carriage 73 reciprocates in the scan direction along the guide rails 173.

The recording head 71 ejects ink supplied from a main tank (cartridge), not illustrated, through nozzle orifices of nozzles 71*a* to record an image on the sheet 195. The specific configuration of the recording head 71 is similar to that of a recording head installed in a widely known ink-jet printer and the detailed description of the configuration is thus omitted.

The transporting mechanism 190 includes a paper feed roller 192, a transport roller 193, an ejection roller 194, the transportation motor 210 that drives the tube pump 1, and the carriage motor 211 that drives the carriage 73. The transportation motor 210 and the carriage motor 211 are controlled by the controller 200.

The maintenance unit 180 is a unit that performs various maintenance operations for maintaining or recovering the ink ejection performance of the recording head 71. The maintenance unit 180 includes the cap 72, the tube pump 1, a liquid waste tank 181, a switching device 182, and the tube 2.

The cap 72 is brought into contact with an ink ejection surface of the recording head 71 by a capping mechanism (not illustrated) while the printer 100 is not performing a printing operation to cover the ink ejection surface (nozzles). The cap 72 is detached from the recording head 71 by the capping mechanism when the printer 100 is to perform the printing operation.

A first end portion of the tube 2 is connected to a suction hole (not illustrated) of the cap 72 and a second end portion of the tube 2 is connected to the liquid waste tank 181. The tube pump 1 is disposed in the middle of the tube 2. The switching device 182 is disposed between the first end portion of the tube 2 and the tube pump 1.

The switching device 182 is configured so as to leave the inner space of the cap 72 open to the atmosphere or close the inner space. The switching device 182 may be, for example, an open-close valve. When the roller 5 of the tube pump 1 is revolved at the pressing position 43P by the rotation of the rotatable body 4 while the cap 72 is covering the recording head 71 and the switching device 182 is closing the inner space of the cap 72 so that the inner space is disconnected from the atmosphere, a negative pressure occurs inside the cap 72. Thus, ink remaining in the nozzles of the recording head 71 and/or the cap 72 is ejected to the tube 2 and then to the liquid waste tank 181 through the tube 2.

As illustrated in FIG. 10, the controller 200 includes a first substrate and a second substrate. On the first substrate, a central processing unit (CPU) 201, a read-only memory (ROM) 202, a random-access memory (RAM) 203, and an electrically erasable programmable read only memory (EEPROM) 204 are mounted. On the second substrate, an application specific integrated circuit (ASIC) 205 is mounted. To the ASIC 205, components such as the transportation motor 210, the carriage motor 211, and the recording head 71 are connected through drivers (not illustrated).

When the CPU 210 receives an input of a print job from an external device such as a personal computer (PC), the CPU 210 outputs a command of print jot execution to the ASIC 205 on the basis of a program stored in the ROM 202. The ASIC 205 drives each driver on the basis of this command. The RAM 203 is a memory that temporarily stores various types of data.

Operation of Printer

Referring now to FIG. 1 to FIG. 6B, FIG. 9, and FIG. 10, the operation of the printer 100 according to the fourth embodiment is described.

Firstly, a case is assumed where a user inputs execution of a cleaning operation (maintenance operation) of the recording head 71 by operating, for example, an operating unit of the printer 100, not illustrated. At this time, the roller 5 of the tube pump 1 is located at the release position 43R, at which the roller 5 is not in contact with the tube 2, to minimize deterioration of the tube 2. The cap 72 is in the state of covering the recording head 71.

The controller 200 executes a program recorded in the ROM 202 in response to a user's input of the cleaning operation execution, so that the following operation is executed.

The controller 200 controls the switching device 182 so that the switching device 182 closes the tube 2 and controls the transportation motor 210 so that the transportation motor 210 rotates the rotatable body 4 in the direction of an arrow A illustrated in FIG. 2. Thus, the roller 5 is revolved in the direction of an arrow A by the rotation of the rotatable body 4. When the lower end portion of the roller 5 comes into contact with the first contact portion 61, the roller 5 is moved toward the outer end portion of the first contact portion 61.

When the roller 5 arrives at the pressing position 43P, the lower end portion of the roller 5 becomes separated from the first contact portion 61 and the upper end portion of the first roller shank 51 comes into contact with the second end portion of the guide portion 43 and the roller body 50 comes into contact with the tube 2. Thus, the roller 5 is revolved in the direction of an arrow A by the rotation of the rotatable body 4 while pressing the tube 2. Thus, a negative pressure occurs inside the cap 72 and ink remaining inside the nozzles of the recording head 71 and/or the cap 72 is ejected to the tube 2 and then to the liquid waste tank 80 through the tube 2.

The controller 200 controls the transportation motor 210 so that the transportation motor 210 rotates the rotatable body 4 in the direction of an arrow A illustrated in FIG. 2 for a predetermined time period and then controls the switching device 182 so that the inner space of the cap 72 is connected to the atmosphere. The controller 200 then controls the transportation motor 210 so that the transportation motor 210 rotates the rotatable body 4 in the direction of an arrow B illustrated in FIG. 2.

At this time, the controller 200 controls the transportation motor 210 so that the roller 5 is revolved at least once around the rotation shaft 40. Thus, the roller 5 is allowed to move from the pressing position 43P to the release position 43R whichever point of the pressing position 43P on the revolution orbit the roller 5 is located.

The printer 100 according to the fourth embodiment can dispense with a sensor that detects the rotation angle of the rotatable body 4, whereby the production cost of the printer 100 can be reduced.

When the roller 5 moves from the pressing position 43P to the release position 43R and is revolved at the release position 43R, the roller 5 is prevented from coming into contact with the tube 2. Thus, the fluid inside the tube 2 is prevented from flowing backward.

Moreover, when the roller 5 is revolved at the release position 43R, the fluid inside the tube 2 is prevented from flowing backward. Thus, the printer 100 according to the fourth embodiment can dispense with a detector that detects the movement of the roller 5 toward the release position 43R unlike an existing printer. The printer according to the fourth embodiment does not have to control the transportation motor 210 in such a manner that the transportation motor 210 stops rotation of the rotatable body 4 in response to arrival of the roller 5 at the release position 43R.

Since the printer 100 according to the fourth embodiment can dispense with a position sensor that detects the position of the roller 5 and a sensor that detects the rotation angle of the rotatable body 4, the production cost of the printer 100 can be reduced. The printer 100 according to the fourth embodiment can reduce costs for developing control programs and other costs without the need for controlling complex factors such as the position of the roller 5 and the rotation angle of the rotatable body 4.

In some cases, the roller 5 passes by the first contact portion 61 while being revolved at least once at the release position 43R. In such a case, the roller 5 and the rotatable body 4 come into contact with each other and produce an impulsive sound.

In the printer 100 according to the fourth embodiment, however, a lower portion of the roller body 50 and the second member 42 are prevented from coming into contact with each other when the roller 5 passes by the first contact portion 61 since the second member 42 of the rotatable body 4 has the second clearance 45. In addition, the area of the second member 42 over which the second member 42 comes into contact with the second roller shank 52 can be minimized. Thus, an impulsive sound that occurs when the roller 5 and the second member 42 come into contact with each other can be reduced.

As described above, the printer 100 according to the fourth embodiment includes the tube pump 1 according to the first embodiment. Thus, the printer 100 attains operation effects of the tube pump 1 according to the first embodiment.

In the printer 100 according to the fourth embodiment, the transportation motor 210 is described as an example of a driving device that drives the tube pump 1. However, the driving device is not limited to this. The tube pump 1 may be driven by the carriage motor 211.

The printer 100 according to the fourth embodiment has a configuration including the tube pump 1 according to the first embodiment. However, the configuration is not limited to this. The printer 100 may have a configuration including the tube pump 1 according to the second embodiment or the third embodiment.

Figure 11:
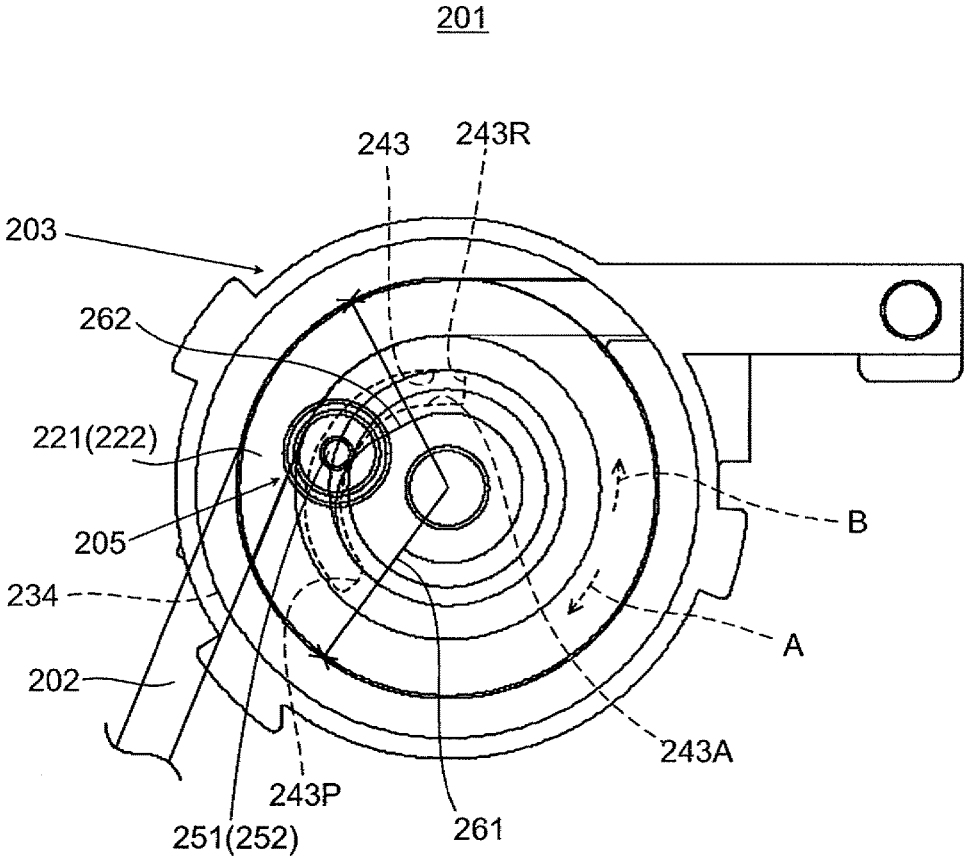
FIG. 11 is a schematic diagram of a rough configuration of the tube pump according to a fifth embodiment.
Figure 12:
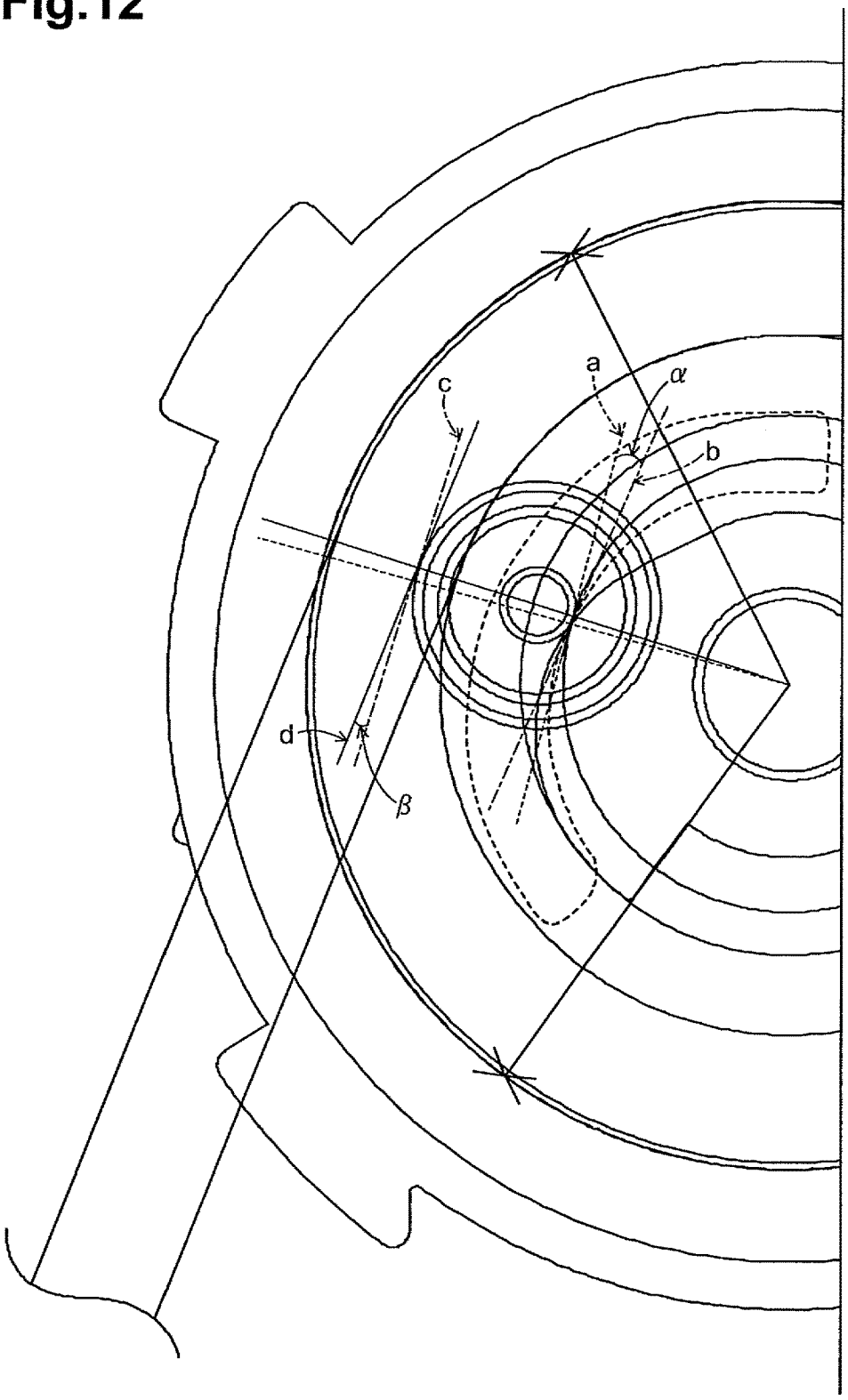
FIG. 12 is a schematic diagram of a rough configuration of the tube pump according to the fifth embodiment.

FIGS. 11 and 12 are schematic diagrams of a rough configuration of a tube pump according to the fifth embodiment.

Figure 13:
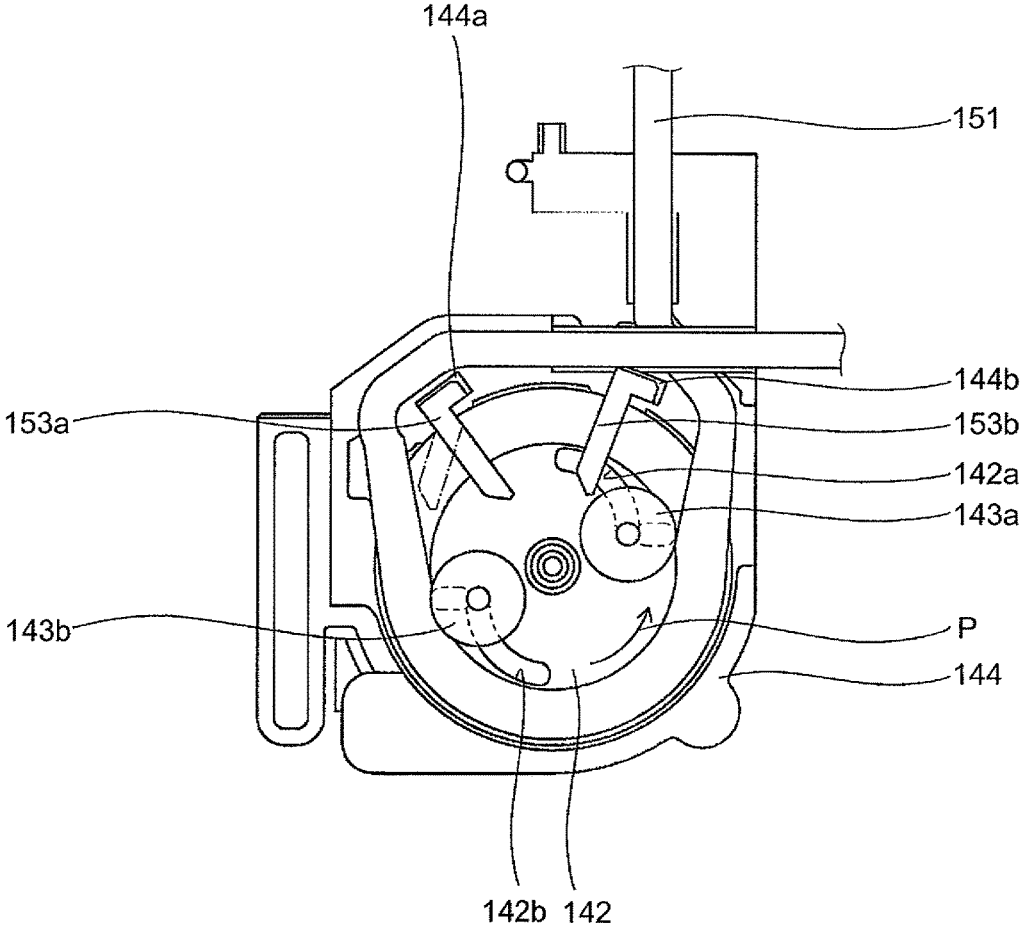
FIG. 13 is a perspective view of the configuration of an existing tube pump disclosed in a prior art.

As illustrated in FIGS. 11 and 12, a tube pump 201 has a different configuration from the tube pump 1 of the first embodiment and includes a rotatable body 234 including a guide portion 243. The guide portion 243 is longer in length than the guide portion 43 of the first embodiment in the direction of an arrow A. As illustrated in FIG. 13, an angle which a direction of an arrow b in which a guide wall 243A of the guide portion 243 presses a first roller shank 251 of a roller 205 forms with a direction of an arrow a in which the first roller shank 251 moves, is referred to as a pressure angle α. An angle which a direction of an arrow d orthogonal to a diameter direction of the rotatable body 234 forms with a direction of an arrow c in which a surface of a tube 202 extends, is referred to as an angle β. Rolling friction between the roller 205 and the tube 202 is referred to as rolling friction μ. A shape of the guide portion 243 is determined so as to satisfy Expression 1.

$$\alpha<\sin^{-1}(\mu+\cos\beta) \quad \text{[Expression 1]}$$

Similar to the first embodiment 1, the rotatable body 234 includes a second member 242, which is formed in a fan shape. A second roller shank 252 of the roller 205 is movable in a direction away from the center of the rotatable body 234 with respect to the diameter direction of the rotatable body 234. A boundary portion between a first contact portion 261 and a second contact portion 262 is in the form of a curved surface such that the second roller shank 252 can move smoothly along the boundary portion. When the second roller shank 252 contacts the boundary portion between the first contact portion 261 and the second contact portion 262 on its way to the pressing position 243P by rotation of the rotatable body 234 in the direction of an arrow B, the second roller shank 252 moves so as to pass over the boundary portion. Therefore, the movement of the roller 205 might not be restricted by the first contact portion 261 and thus the first roller shank 251 might not reach the pressing position 243P. Although the roller 205 is in contact with the tube 202, friction between the roller 205 and the tube 202 is relatively small. Accordingly, the roller 205 might not remain at a particular position so as not to move together with the rotatable body 234 while the rotatable body 234 rotates.

In a case that the pressure angle α of the guide wall 243A relative to the first roller shank 251 is relatively small, the first roller shank 251 can move along the guide wall 243A by rotation of the rotatable body 234. However, the guide wall 243A has a small inclination in the diameter direction of the rotatable body 234 with respect to the rotation direction of the rotatable body 234 and has a relatively long length in the rotation direction of the rotatable body 234. In a case that pressure angle α is relatively large, the guide wall 243A has a shorter length in the rotation direction of the rotatable body 234 than the length of the guide wall 243A having a relatively small pressure angle α. However, the first roller shank 251 might not move along the guide wall 243A.

The tube 202 extends to the outside of a housing member 203. Therefore, a second portion 222 of the tube 202 extends along a direction of an arrow d outside the housing member 203. When the roller 205 contacts the second portion 222 of the tube 202, the roller 205 receives a reaction force from the tube 202 in the direction of an arrow d. The reaction force from the tube 202 when the roller 205 contacts the second portion 222 of the tube 202 is greater than a reaction force from the tube 202 when the roller 205 contacts at another portion of the tube 202. Therefore, in a case that the roller 205 contacts the second portion 222 of the tube 202, the roller 205 might not move together with the rotatable body 234 while the rotatable body 234 rotates.

Thus, while the roller 205 is stayed at the particular position by the reaction force, the first roller shank 251 can move along the guide portion 243. When the roller 205 contacts the second portion 222, the roller 205 remains at the particular position while the rotatable body 234 rotates. Accordingly, the roller 205 can surely reach the pressing position 243P. In the fifth embodiment, the pressure angle α is larger than a case where the pressure angle α is determined such that the roller 205 remains while the rotatable body 234 rotates also when the roller 205 contact another portion of the tube 202. Therefore, the length of the guide wall 243A in the rotation direction of the rotatable body 234 can be shortened. Accordingly, while the guide portion 243 has an appropriate length in the rotation direction of the rotatable body 234, the guide portion 243 can have an appropriate shape.

Various modification or other embodiments of the invention are obvious to persons having ordinary skill in the art from the above description. Thus, the above description should be considered as mere illustrative examples and is provided to teach the best mode of carrying out the invention to persons having ordinary skill in the art. The details of the configuration and/or the functions are substantially changeable without departing from the gist of the invention. Various components disclosed in the embodiments may be appropriately combined to construct different modes of the invention.

What is claimed is:

1. A tube pump comprising:

a tube through which fluid is flowed;

a housing member comprising a cylindrical chamber in which the tube is accommodated, the cylindrical chamber including an inner peripheral surface along which the tube is arranged;

a rotator comprising a first shaft and a first portion provided on the first shaft, the first portion including a guide having first and second ends, the first end positioned a first distance from the first shaft, the second end positioned a second distance from the first shaft, the second distance being greater than the first distance;

a roller having a first shank received by the guide, the roller configured to selectively press the tube to deform the tube; and a contact member having a contact portion in the cylindrical chamber extending outwardly towards the inner peripheral surface at least the first distance and less than the second distance, the contact portion formed by the housing member, the contact portion being configured to selectively contact the roller.

2. The tube pump of claim 1, wherein the guide comprises a curved groove defined by the first portion of the rotator, wherein the guide includes a guide wall formed in an inside of the curved groove in a radial direction of the cylindrical chamber, wherein a shape of the guide wall is determined according to $$\alpha<\sin^{-1}(\mu+\cos\beta),$$

wherein αis a pressure angle which a direction in which the guide wall presses the first shank forms with a direction in which the first shank moves, wherein μis a rolling friction between the roller and the tube, and wherein βis an angle which a direction orthogonal to a diameter direction of the rotator forms with a direction in which a surface of the tube extends.

3. The tube pump of claim 2, wherein the housing member includes a bottom surface of the cylindrical chamber, wherein the contact portion is formed by the bottom of the cylindrical chamber.

4. The tube pump of claim 1, wherein the first portion of the rotator is disc shaped and includes a first side facing an open end of the cylindrical chamber and a second side opposite the first side, and wherein the guide is on the second side of the first portion of the rotator.

5. The tube pump of claim 1, wherein the roller further includes a roller body and a second shank, the first and second shanks extending axially from the roller body, wherein the second shank is configured to contact the contact portion when the first shank is positioned in the first end of the guide.

6. The tube pump of claim 5, wherein the second shank is configured to not contact the contact portion when the first shank is positioned in the second end of the guide.

7. The tube pump of claim 1, wherein the guide is configured to position the first shank in the first end of the guide in response to rotation of the rotator in a first rotation direction, and position the first shank in the second end of the guide in response to rotation of the rotator in a second rotation direction.

8. The tube pump of claim 1, wherein the roller is configured to revolve in response to rotation of the rotator.

9. A tube pump comprising:

a tube through which fluid is flowed;

a housing member comprising a cylindrical chamber in which the tube is accommodated, the cylindrical chamber including an inner peripheral surface along which the tube is arranged;

a rotator comprising a rotation shaft and a first portion provided on the rotation shaft, the first portion including a guide, the rotator being rotatable in the cylindrical chamber;

a roller received by the guide to be moved between a pressing position and a release position when the rotator is rotated in first and second rotation directions, respectively; and a contact portion formed by the housing member, wherein the roller contacts the contact portion when the rotator rotates in the first rotation direction to move the roller from the release position to the pressing position, and the roller does not contact the contact portion when the rotator rotates in the second rotation direction.

10. The tube pump of claim 9, wherein the roller is configured to revolve in first and second directions in response to rotation of the rotator in first and second directions, respectively.

11. The tube pump of claim 10, wherein the roller includes a first shank received by the guide and a second shank configured to contact the contact portion when the rotator rotates in the first rotation direction.

12. The tube pump of claim 9, wherein the roller is configured such that when in the pressing positon the roller presses the tube to deform the tube for generating a pressure in the tube, and when in the release position the roller is displaced from the release position and pressure in the tube is not generated.

* * * * *